US009991639B2

(12) United States Patent
Resendez et al.

(10) Patent No.: US 9,991,639 B2
(45) **Date of Patent: *Jun. 5, 2018**

(54) WAFER CONNECTOR WITH GROUNDING CLAMP

(71) Applicant: Molex, LLC, Lisle, IL (US)

(72) Inventors: Javier Resendez, Streamwood, IL (US); Michael Rost, Lisle, IL (US); Christopher Wanha, Dublin, CA (US); Frank Keyser, Elk Grove Village, IL (US)

(73) Assignee: Molex, LLC, Lisle, IL (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/847,340

(22) Filed: Dec. 19, 2017

(65) Prior Publication Data

US 2018/0109037 A1 Apr. 19, 2018

Related U.S. Application Data

(63) Continuation of application No. 14/899,879, filed as application No. PCT/US2014/045860 on Jul. 9, 2014, now Pat. No. 9,859,659.

(Continued)

(51) Int. Cl.

| | |
|---|---|
| ***H01R 13/648*** | (2006.01) |
| ***H01R 13/6585*** | (2011.01) |
| ***H01R 13/6594*** | (2011.01) |
| ***H01R 13/514*** | (2006.01) |
| ***H01R 13/6593*** | (2011.01) |
| ***H01R 9/03*** | (2006.01) |

(Continued)

(52) U.S. Cl.
CPC ..... *H01R 13/648* (2013.01); *H01R 9/035* (2013.01); *H01R 13/514* (2013.01);
(Continued)

(58) Field of Classification Search
CPC ..... H01R 13/65802; H01R 13/4532; H01R 23/662
(Continued)

(56) References Cited

U.S. PATENT DOCUMENTS 5,176,538 A * 1/1993 Hansell, III ..... H01R 23/662 439/607.23
6,203,376 B1 3/2001 Magajne et al.
(Continued)

FOREIGN PATENT DOCUMENTS

JP 2001-035567 A 2/2001
JP 2001-102133 A 4/2001
(Continued)

*Primary Examiner* — Phuong Chi T Nguyen
(74) *Attorney, Agent, or Firm* — Jeffrey K. Jacobs

(57) ABSTRACT

A wafer connector is disclosed in which a plurality of twin-axial wires are terminated to the tails of ground and signal terminals of the connector. Each twin-axial wire includes a pair of signal wires enclosed in a conductive sheath. A conductive grounding clamp is provided that contacts the sheaths of the twin-axial wires and holds them together as a unit to facilitate the attachment of the wires to the connector terminal tails. The clamp has two opposing halves that cooperatively define openings which receive the twin-axial wires and flat, interconnecting portions extending between the openings that provide contact points where the grounding clamp may be attached to the connector terminal tails.

20 Claims, 3 Drawing Sheets

Related U.S. Application Data

(60) Provisional application No. 61/844,765, filed on Jul. 10, 2013.

(51) Int. Cl.
*H01R 12/53* (2011.01)
*H01R 12/59* (2011.01)

(52) U.S. Cl.
CPC ..... *H01R 13/6585* (2013.01); *H01R 13/6593* (2013.01); *H01R 13/6594* (2013.01); *H01R 12/53* (2013.01); *H01R 12/594* (2013.01)

(58) Field of Classification Search
USPC ..... 439/607, 497, 610, 143
See application file for complete search history.

(56) References Cited

U.S. PATENT DOCUMENTS

| | | | | |
|---|---|---|---|---|
| 6,338,653 | B1 | 1/2002 | Jones et al. | |
| 6,764,342 | B2 | 7/2004 | Murayama et al. | |
| 6,831,230 | B2 | 12/2004 | Ide et al. | |
| 6,893,295 | B1 | 5/2005 | Lloyd et al. | |
| 7,438,565 | B2 * | 10/2008 | Hamazaki | H01R 13/6658 439/108 |
| 7,950,953 | B2 * | 5/2011 | Kuwahara | H01R 12/62 439/497 |
| 8,558,568 | B2 | 10/2013 | Uesaka et al. | |
| 8,758,051 | B2 | 6/2014 | Nonen et al. | |
| 8,870,597 | B2 * | 10/2014 | Kawakami | H01R 13/6471 439/108 |
| 9,362,632 | B2 | 6/2016 | Sunaga et al. | |
| 2003/0073331 | A1 | 4/2003 | Peloza et al. | |
| 2004/0229510 | A1 | 11/2004 | Lloyd et al. | |
| 2012/0090866 | A1 | 4/2012 | Gundel | |
| 2012/0090872 | A1 | 4/2012 | Gundel | |

FOREIGN PATENT DOCUMENTS

| | | | |
|---|---|---|---|
| JP | 2004-071384 | A | 3/2004 |
| JP | 4091348 | B2 | 5/2008 |
| JP | 2010-205604 | A | 6/2010 |

* cited by examiner

WAFER CONNECTOR WITH GROUNDING CLAMP

REFERENCE TO RELATED APPLICATIONS

This application claims priority to U.S. application Ser. No. 14/899,879, filed Dec. 18, 2015, now U.S. Pat. No. 9,859,659, which is a national phase of PCT Application No. PCT/US2014/045860, filed Jul. 9, 2014, which in turn claims priority to prior-filed U.S. Provisional Patent Application No. 61/844,765, entitled "Wafer Connector With Grounding Clamp," filed on 10 Jul. 2013, all of which are incorporated herein by reference in their entirety.

BACKGROUND OF THE PRESENT DISCLOSURE

The Present Disclosure relates, generally, to wafer connectors, and, more particularly, to a wafer connector having an improved grounding member incorporated therein for use in terminating multiple wire cables.

Cable assemblies are used to connect many electronic components together, especially in the telecommunications industry. Cables contain multiple wires and each wire is terminated to a single signal terminal in a cable connector, typically referred to as a wafer connector due to its size. The cable wires have individual conductors that are enclosed, in an insulative covering and the wires, in pairs, are then wrapped in a conductive foil, or other type of sheathing, that serves as an exterior ground which extends the entire lengths of the wire pairs. In twin-axial drain-type systems, two conductive wires are disposed on the exterior of the wire pairs, in contact with the conductive foil and run the entire length of the wire pairs in order to provide a means for terminating the conductive foil to ground conductors of connectors disposed at opposite ends of the cable.

In drain-type cable systems, care must be taken to unwrap the shielding foil and expose the drain wires so they may be terminated to their corresponding ground terminal tails of the end connectors. Some cable systems are drainless, meaning that no drain wires are provided and other means of making contact between the outer conductive foil and then connector ground terminals must be utilized. One manner of termination in such systems uses specially formed nests made as part of the ground terminals. These nests have a semicircular, or U-shaped configuration to form a wide surface that makes contact with the conductive foil of the wire pairs. This requires additional stamping and forming of the ground terminal as well as increases the height of the ground terminals within the connectors. This leads to increased cost and size of the cable systems. Additional labor is also required to ensure that the wires are properly set in the nest. Accordingly, a need exists for a grounding structure for use in drainless cable applications that is inexpensive and easy to assemble, and which interconnects multiple grounding foils of a multi-wire cable.

The Present Disclosure is therefore directed to a grounding structure in the form of a clamp formed to securely make grounding contact with a plurality of the wire pairs of the cable, connect the conductive foils of adjacent wire pairs together, and hold the twin-axial wires together as a single unit for termination to the tails of an associated wafer connector.

SUMMARY OF THE PRESENT DISCLOSURE

Accordingly, there is provided a grounding structure in the form of a clamp that holds the twin-axial wires in place in a preselected spacing by contacting their exterior grounding sheaths together as a group in a preselected spacing and which is provided with a plurality of connection points on the clamp for connecting to ground terminal tail portions of the wafer connector.

In accordance with an embodiment as described in the Present Disclosure, the clamp may be provided with an elongated body portion formed from two similar halves. The clamp body portion takes the form of a wide conductive strip oriented transversely to the axial direction of the cable wires. The clamp body portion has a configuration that includes plurality of peaks and valleys formed therein such the valley portions of the two clamp halves cooperatively form an opening, or passage sized to receive a wire pair therein, along with its outer conductive foil. The intervening peaks of the two clamp halves mate together and serve to interconnect adjacent pairs of wires together.

These peaks define tabs that extend between the wire pairs, all of which preferably lie in a common plane. As such, the grounding clamp serves to hold the signal wire pairs in place for easy and reliable termination. Likewise, the tabs defined between adjacent wire pairs provide reliable and large points of contact for connecting to the ground terminal tail portions of the wafer connector. The overall configuration of the grounding clamp, when attached to the wire pairs, permits the termination process to be more easily automated. Additionally, the width of the grounding clamp provides additional shielding in the termination area so a designer can use the grounding clamp to modify the impedance of the connector system at the termination area.

These and other objects, features and advantages of the Present Disclosure will be clearly understood through a consideration of the following detailed description.

BRIEF DESCRIPTION OF THE FIGURES

The organization and manner of the structure and operation of the Present Disclosure, together with further objects and advantages thereof, may best be understood by reference to the following Detailed Description, taken in connection with the accompanying Figures, wherein like reference numerals identify like elements, and in which.

DESCRIPTION OF THE PREFERRED EMBODIMENTS

While the Present Disclosure may be susceptible to embodiment in different forms, there is shown in the Figures, and will be described herein in detail, specific embodiments, with the understanding that the Present Disclosure is to be considered an exemplification of the principles of the Present Disclosure, and is not intended to limit the Present Disclosure to that as illustrated.

As such, references to a feature or aspect are intended to describe a feature or aspect of an example of the Present Disclosure, not to imply that every embodiment thereof must have the described feature or aspect. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the embodiments illustrated in the Figures, representations of directions such as up, down, left, right, front and rear, used for explaining the structure and movement of the various elements of the Present Disclosure, are not absolute, but relative. These representations are appropriate when the elements are in the position shown in the Figures. If the description of the position of the elements changes, however, these representations are to be changed accordingly.

Figure 1:
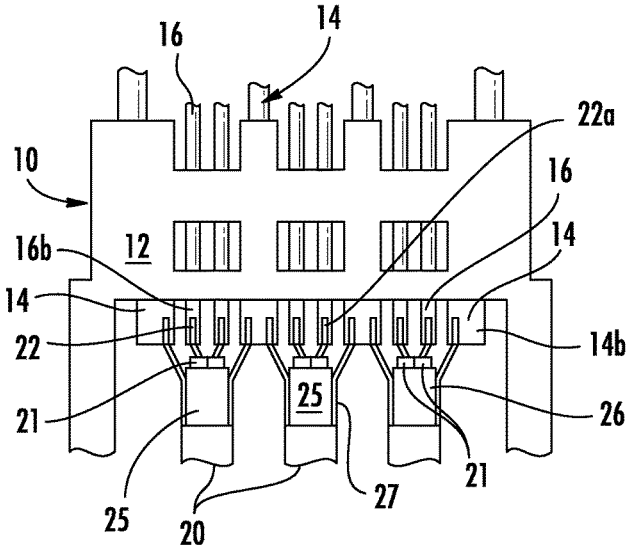
FIG. 1 PRIOR ART
FIG. 1 is a top plan view of the termination area of a conventional drain-type twin-axial wire termination to individual ground and signal terminal tail portions of the connector.

Turning to FIG. 1, a conventional wafer connection and associated wire termination is illustrated in a plan view format. The wafer connector 10 is defined by an insulative frame 12 that supports a plurality of individual, conductive ground and signal terminals 14, 16. The frame supports the ground and signal terminals in a preselected spacing and in the usual ground-signal-signal-ground order found in connectors of this type. A multi-wire cable (not shown) is terminated to the connector 10. The cable contains a plurality of twin-axial wires 20, so called because each of the twin-axial wires contains a dedicated pair of signal transmission wires 21. Each of the signal wires includes a single conductor 22 encased in an insulative covering 23. The wires 21 are arranged in their dedicated pairs by way of an outer conductive shield 25 that extends the length of the wire pair and which typically takes the form of a conductive foil 26 wrapped so as to enclose the wire pair together. A pair of drain wires 27 is provided for each twin-axial wire 20 and they extend along the length of the twin-axial wires 20 in contact with the conductive shield 25. The drain wires 27 have free ends 27*a* which are terminated to the ground terminal tail portions 14*b*, while the signal conductors 22 have free ends 22*a* which are terminated to the signal terminal tail portions 16*b*.

In practice, the conductive shield 25 is peeled back upon itself and the drain wire free ends 27*a* are separated from the wire pair so that they may be contacted with the ground terminal tail portions 14*b*. Each twin-axial wire is usually terminated individually, and care must be taken to ensure that the many wire free ends 27*a*, 22*a* are contacted with their corresponding associated ground or signal terminal tail portions 14*b*, 16*b*. This leads to expense in the manufacturing process by way of increased labor. Each twin-axial wire pair is terminated individually and hence the process of attachment does not easily lend itself to automation.

Figure 2A:
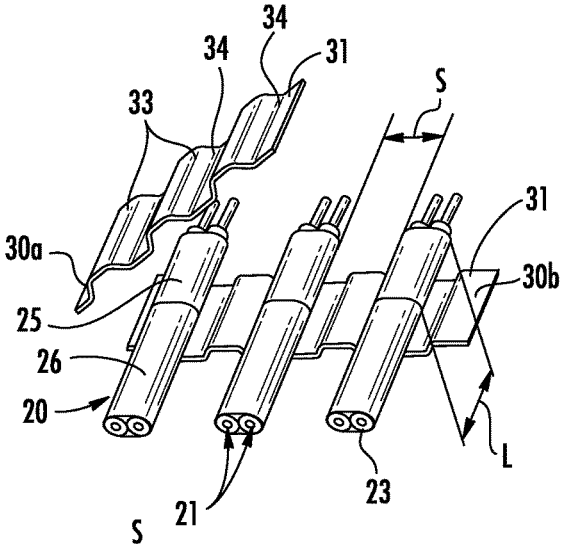
FIG. 2A is a perspective view of a grounding clamp constructed in accordance with the Present Disclosure, with one half of the clamp receiving three twin-axial wires therein and the other half in position for mating with the one half.
Figure 2B:
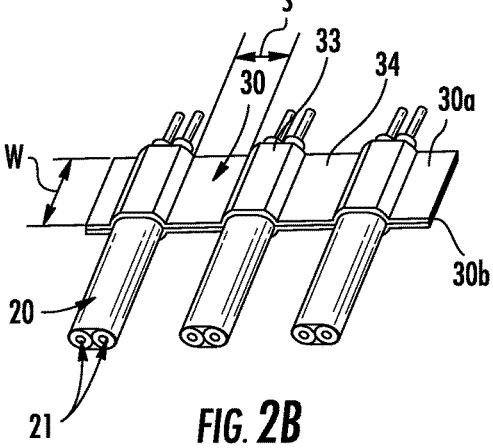
FIG. 2B is the same view as FIG. 2A, but with the grounding clamp halves mated together to clamp the twin-axial wires in place therebetween to form a grounding clamp-wire assembly.
Figure 2C:
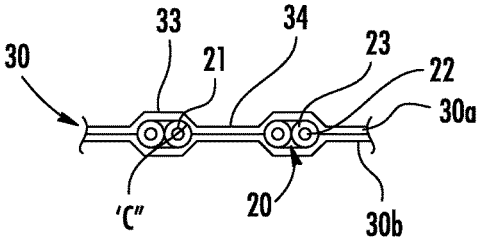
FIG. 2C is an end view of the wire-clamp assembly of FIG. 2B.
Figure 3B:
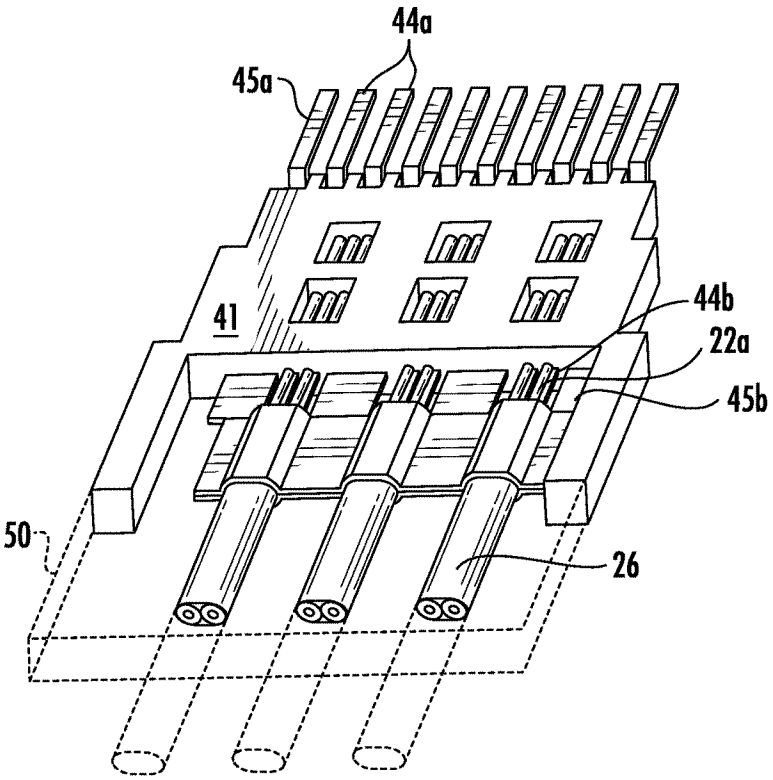
FIG. 3B is the same view as FIG. 3B, but with the grounding clamp and signal wire free ends terminated to corresponding ground and signal terminal tail portions of the wafer connector.
Figure 3A:
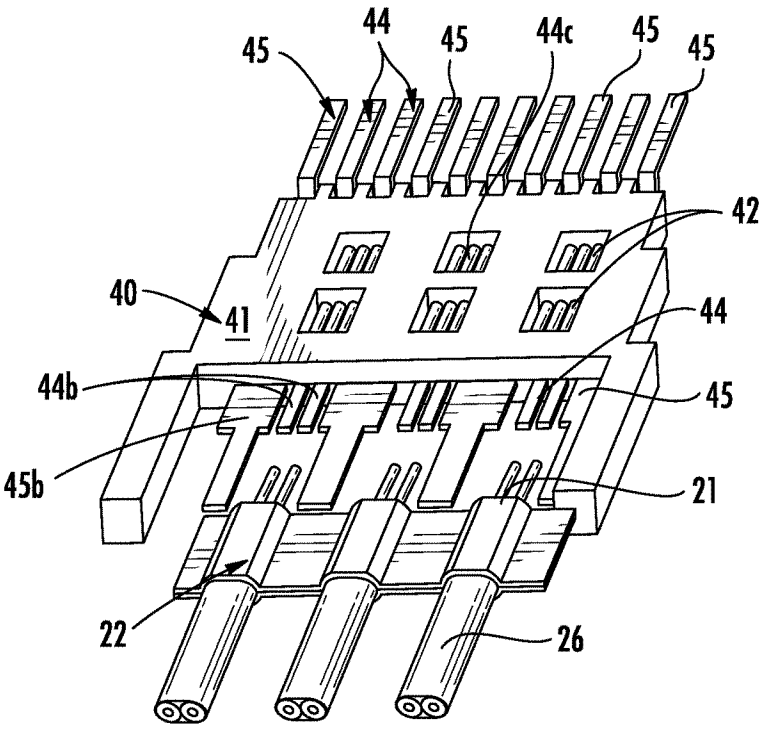
FIG. 3A is a perspective view of the grounding clamp-wire assembly of FIG. 2B in position for attachment to the ground and signal terminal tail portions of a wafer connector.
Figure 4:
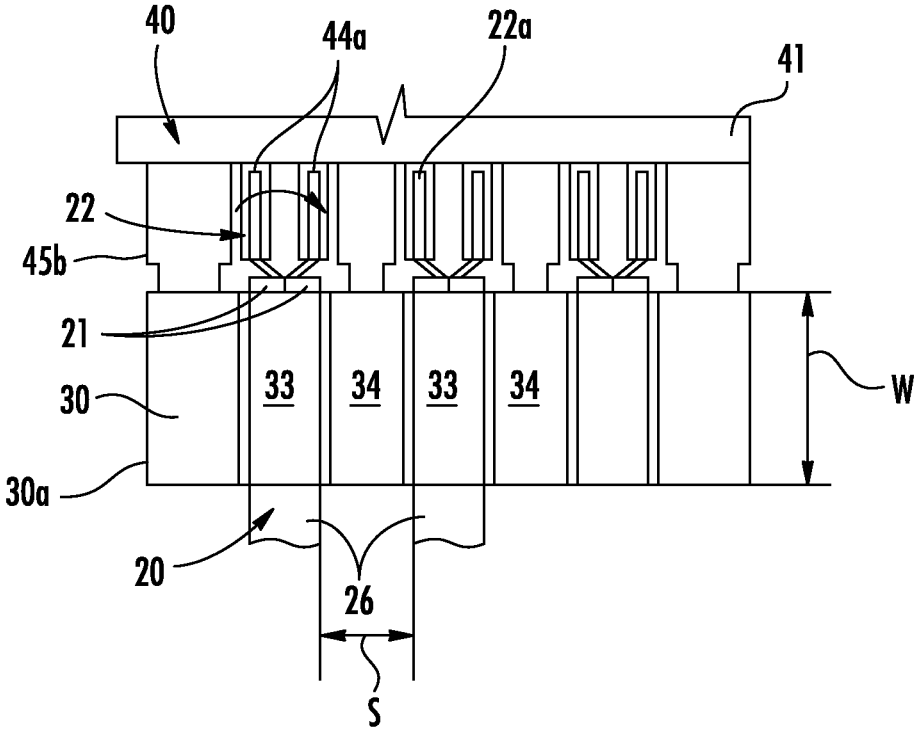
FIG. 4 is an enlarged detail top plan view of the termination area of the connector-clamp-wire assembly of FIG. 3B.

FIGS. 2-4 illustrate a grounding clamp 30 for a wafer connector constructed in accordance with the principles of the Present Disclosure. The grounding clamp 30 is utilized with twin-axial wires 20, each such wire 20 containing two dedicated signal wires 21 that include central signal conductors 22 surrounded by an insulative covering 23. The two signal wires are wrapped, or otherwise enclosed within a conductive sleeve, or sheath 25 that extends the length of the twin-axial wires 20. This conductive sheath 25 is, in turn, enclosed by an outer insulative coating or sleeve 26 so that the two signal wires 21 are held together as a single unit.

The grounding clamp 30 is shown in FIGS. 3A-B as being formed from two halves 30*a*, 30*b*, each of which can be considered as a mirror image of the other. The grounding clamp halves 30*a*, 30*b* each have an elongated body portion 31 with a preselected width, W, and the clamp body portion 31 is arranged to extend transversely to the axial direction of the twin-axial wires 20 of the cable. In order to provide the intended grounding function, the grounding clamp halves 30*a*, 30*b* are preferably formed from a conductive material that can be molded or stamped and formed into the desired configuration. In this regard, the clamp may be made of a conductive foil or sheet metal, die cast from an conductive material, molded from a conductive plastic or formed from a material subsequently plated with a metal coating. Other suitable materials or processes may be used so long as they render the ground clamp conductive.

The ground clamp 30, as illustrated, and particularly, its two clamp halves 30*a*, 30*b* have a configuration that accommodates its engagement between the wire pairs. In this regard, the clamp halves 30*a*, 30*b* may be considered as having a series of alternating peaks 33 and valleys 34 when viewed from either their front or rear ends. The peaks 33 of the two clamp halves 30*a*, 30*b* cooperatively provide axially-oriented openings, or passages, between themselves that receive the wire pairs therein. The "peaks" of a clamp half refer to the portions of the clamp 30 that are raised with respect to the central axes C of the signal wire conductors 22. Another way of explaining this is the portions that extend outwardly away from the central axes C. The naming convention used herein can be seen and easily understood from viewing FIG. 2C.

The valleys 34 are those portions of the clamp halves that preferably lie in a common plane and extend along what may be considered as a central horizontal axis. The clamp valleys cooperatively provide contact areas at which the clamp halves 30*a*, 310 may be attached to each other, such as by soldering, welding, interlocking or the like. The valleys 34 further define grounding tabs that not only space the wire pairs apart from each other in a predetermined spacing, S, but also define attachment areas, generally lying in the same plane for attaching the ground clamp, and wire pairs held thereby to the ground terminal tails of the connector. Preferably, the distance between surfaces of opposing peaks 33 is such that the two clamp halves 30*a*, 30*b* firmly hold the twin-axial wire 20 in place therebetween. When the clamp halves 30*a*, 30*b* are attached to each other a grounding clamp-wire assembly is formed.

Turning now to FIGS. 3A-B, a connector 40 is illustrated as having an insulative frame, or housing 41, of a skeletal nature with a plurality of openings 42 formed therein that expose the terminals of the connector to air. The frame 41 supports a plurality of conductive terminals 44, 45 each of which have contact portions 44*a*, 45*a* disposed along a mating end, or face, of the connector and tail portions 44*b*, 44*b*. The contact and tail portions 44*a*, 44*b*, 45*a*, 45*b* are connected together by intervening terminal body portions

44*c*, 45*c*. The terminals 44, 45 of the connector are preferably divided into two distinct sets of terminals: thin signal terminals 44 that are connected to the signal wires of the twin-axial wire pairs, and wider ground terminals 45 that are connected to the exterior conductive sheath of the wire pairs. The terminals 44, 45 are arranged in the connector in a preselected spacing therebetween and this spacing may have one value between the contact portions thereof and other values between the body and tail portions. Alternatively, the spacing between adjacent terminals may be the same throughout the connector.

The terminal tail portions 44*b*, 45*b* of both the signal and ground terminals 44, 45 may be aligned with each other so that they generally lie in a common plane as illustrated. The signal terminals 44 may also be aligned with each other in a first common plane, while the ground terminals 45 may be aligned with each other in a second common plane for an alternative construction. The ground terminal tail portions 45*b*, as best illustrated in FIG. 3A, extend further rearwardly than their associated signal terminals, to take into account the distance L between the leading (forward) edge of the wires insulative covering and the trailing edge of the grounding clamp 30. This distance L should be equal to or less than the width W of the grounding clamp 30.

The flat valleys 34 define contact areas that will make contact with the wider ground terminal tail portions 45*b* when the grounding clamp-wire assembly is positioned in place within the connector frame 41. These contact areas may also be considered as mounting tabs as they are generally flat in order to rest on the wide ground terminal tail portions 45*b*. The signal terminal tail portions 44*b* terminate more forwardly than do the ground terminal tail portions 45*b* so that the signal terminal tail portions do not interfere with or touch the conductive grounding clamp 30. The grounding clamp 30 provides the clamp-wire assembly with a suitable spacing so that the signal wire free ends 22*a* are aligned with the signal terminal tail portions 44*b* when the clamp-wire assembly is properly positioned in the connector frame 41 as illustrated in FIG. 3B. The grounding clamp may thereupon be attached to the terminal tail portions such as by welding or the like. After attachment, the termination area may be overmolded, as indicated by the dashed lines 50 to form an integrated connector body in conjunction with the connector frame 41.

It will be understood that the grounding clamps described herein can be applied to sets of wires to form a structural unit that facilitates assembly of the wafer connectors. The extent of the grounding clamp 30 is substantial in its transverse orientation through the connector and therefore the grounding clamp provides a wide ground plane in the termination area so that designers may calculate the width, thickness and other clamp parameters so as to attain a specific impedance in that connector area.

While a preferred embodiment of the Present Disclosure is shown and described, it is envisioned that those skilled in the art may devise various modifications without departing from the spirit and scope of the foregoing Description and the appended Claims.

What is claimed is:

1. A connector, comprising:

an insulative housing;

a plurality of first and second conductive terminals supported in spaced-apart order by the housing, each terminal including contact portions disposed at a first end thereof and tail portions disposed at a second end thereof, each contact portion being disposed along a mating end of the housing and each tail portion being disposed along a termination end of the housing;

a cable, the cable housing a plurality of wires;

a plurality of conductive sheaths enclosing a pair of wires of the plurality of wires; and a grounding clamp disposed in the insulative housing, the grounding clamp including two opposing halves formed from a conductive material, the two opposing halves cooperatively defining a plurality of axially-oriented passages therebetween and extending axially therethrough, each passage receiving a pair of wires and an associated conductive sheath in a manner such that the halves make electrical contact with the sheaths and space adjacent wire pairs from each other.

2. The connector of claim 1, wherein the two opposing halves are mirror images of each other.

3. The connector of claim 1, wherein the insulative housing includes a portion which has an insulative material molded over the grounding clamp.

4. The connector of claim 1, wherein the grounding clamp holds multiple wires together as a unit in a preselected spacing.

5. The connector of claim 1, wherein the first terminal tail portions have a width that is no greater than a corresponding width of the grounding clamp valleys.

6. The connector of claim 1, wherein the first terminal tail portions are wider than the second terminal tail portions.

7. The connector of claim 1, wherein the first terminal tail portions have a length longer than the second terminal tail portions.

8. The connector of claim 1, wherein the grounding clamp is disposed in the insulative housing rearwardly of the tail portions.

9. The connector of claim 8, wherein the first terminal tail portions do not extend past a rearward edge of the grounding clamp.

10. The connector of claim 1, wherein each half include at least one peak and one valley, the peaks and valleys respectively opposing each other.

11. The connector of claim 10, wherein the halves cooperatively define contact portions of the grounding clamp for attaching the grounding clamp to the tail portions.

12. The connector of claim 10, wherein adjacent first terminal tail portions are spaced apart from each other to define intervening spaces therebetween, the halve peaks being disposed in the intervening spaces.

13. The connector of claim 10, wherein each half includes additional peaks and valleys.

14. The connector of claim 13, wherein the opposing peaks of the halves cooperatively define axial passages therebetween, each axial passage being configured to receive a wire sheath therein.

15. The connector of claim 13, wherein the halves are attached to each other at opposing valleys thereof.

16. The connector of claim 13, wherein opposing valleys of the halves define spacers that space adjacent wire sheaths apart from each other in preselected spacings.

17. A cable connector assembly, comprising:

an insulative connector housing;

a plurality of conductive terminals supported by the housing, each terminal including ground and signal terminals arranged so that adjacent ground terminals are separated from each other by a pair of intervening signal terminals, the ground and signal terminals including tail portions disposed along a termination end of the housing;

a cable that encloses a plurality of wires, each wire being arranged in dedicated pairs, the wires of each dedicated pair being enclosed in a conductive sleeve, the sleeve ending at a termination end of the cable, the wires having free ends that extend past the cable termination end; and a conductive clamp member disposed in the insulative connector housing, the clamp member including a plurality of axially-oriented passages which extend axially through the clamp member, each passage receiving a dedicated pair of wires and an associated conductive sleeve therein, the clamp member further including a plurality of flat portions disposed between adjacent passages;

whereby the clamp member makes electrical contact with the conductive sleeves and spaces adjacent wire pairs from each other, the flat portions contacting the ground terminal tail portions.

18. The cable connector assembly of claim 17, wherein the clamp member further includes two halves, each half including peak and valley portions and wherein the peak portions of each half cooperatively define the passages, and the valley portions cooperatively define the flat portions.

19. The cable connector assembly of claim 17, wherein the insulative connector housing includes a portion which has an insulative material molded over the clamp member.

20. The cable connector assembly of claim 17, wherein the ground terminal tail portions being longer than the signal terminal tail portions.

* * * * *